US005703312A

United States Patent [19]

Takahashi et al.

[11] Patent Number: 5,703,312

[45] Date of Patent: Dec. 30, 1997

[54] ELECTRONIC MUSICAL INSTRUMENT AND SIGNAL PROCESSOR HAVING A TONAL EFFECT IMPARTING FUNCTION

[75] Inventors: Makoto Takahashi; Kiyoshi Hasebe, both of Hamamatsu, Japan

[73] Assignee: Yamaha Corporation, Hamamatsu, Japan

[21] Appl. No.: 527,147

[22] Filed: Sep. 12, 1995

[30] Foreign Application Priority Data

Sep. 13, 1994 [JP] Japan ..... 6-244832
Jul. 26, 1995 [JP] Japan ..... 7-210996

[51] Int. Cl.[6] ..... G10H 1/00; G10H 1/02

[52] U.S. Cl. ..... 84/626; 84/630; 84/662; 381/61; 381/63

[58] Field of Search ..... 84/626–633, 662–665; 381/61–65

[56] References Cited

U.S. PATENT DOCUMENTS

| | | | |
|---|---|---|---|
| 4,524,668 | 6/1985 | Tomisawa et al. | 84/1.24 |
| 4,998,281 | 3/1991 | Sakata | 381/63 |
| 5,221,803 | 6/1993 | Izumisawa et al. . | |
| 5,276,273 | 1/1994 | Takauji | 84/615 |
| 5,542,000 | 7/1996 | Semba | 381/61 |
| 5,546,466 | 8/1996 | Ishiguro et al. | 381/61 |

FOREIGN PATENT DOCUMENTS

| | | |
|---|---|---|
| 204122 | 12/1986 | European Pat. Off. . |
| 463411 | 1/1992 | European Pat. Off. . |

OTHER PUBLICATIONS

EPO Search Report EP 95 11 4273, Dec. 29, 1995.

*Primary Examiner*—William M. Shoop, Jr.
*Assistant Examiner*—Marlon T. Fletcher
*Attorney, Agent, or Firm*—Loeb & Loeb LLP

[57] ABSTRACT

There are provided a tone source for generating tone signals in plural channels independently and effect impartment sections, provided in corresponding relations to the channels, for imparting individual effects to the tone signals of the channels generated by the tone source. Each of the effect impartment sections, in accordance with tone control information unique to the tone signal of the corresponding channel, controls a parameter of the effect to be imparted. In a case where any of the effect impartment sections uses a signal delaying memory to impart an effect, when a damping (or truncating process) is performed in any of the channels, the storage area to be used for the channel is switched to another unused storage area so as to prevent any preceding tone's delayed signal from being undesirably mixed into the signal of a new tone. In an application where a DSP is used to perform effect impartment, tone synthesis or the like, the size and position of a storage area for storing processed data are set variably to achieve efficient use of data memory. Further, a DSP program of different algorithms is automatically selected in accordance with performance information, to provide processing variety.

8 Claims, 10 Drawing Sheets

ELECTRONIC MUSICAL INSTRUMENT AND SIGNAL PROCESSOR HAVING A TONAL EFFECT IMPARTING FUNCTION

BACKGROUND OF THE INVENTION

The present invention relates to an electronic musical instrument and an effector capable of imparting a desired effect to a tone signal.

The present invention also relates to signal processing, and more particularly to a signal processor for performing tone generation and tone signal processing which permits efficient use of memory, dynamic selection of a program and dynamic allocation of memory.

Conventionally known electronic musical instruments containing an effector (effect imparting device) are designed to generate tones after imparting one or more effects per tone color. For example, in those instruments using a so-called multi-timbre tone source to produce plural tone colors, one or more effects are imparted for each tone color.

However, although the known electronic musical instruments could impart a different effect for each tone color, they were unable to vary the effect imparting mode of a same tone color in response to variations in key-on or key-off event occurrence timing and in key velocity value. The prior instruments could not vary effect imparting timing separately for each tone generation channel in response to variations in key-on or key-off event occurrence timing, nor could they control an effect imparting parameter separately for each tone generation channel in response to variations in key velocity value.

Digital signal processors (hereinafter referred as DSPs) have conventionally been employed to impart various effects to sounds or tones or generate sounds or tones. Recently, it is common for such DSPs to perform plural processes within one sampling period. Further, in view of the fact that great advancement in LSI technology has made it possible for today's DSPs to perform large-scale signal processing and has considerably increased the amount of program processable per sampling period, there is a great demand today for an improved DSP which, rather than merely performing complex processing can appropriately use any of plural different programs according to the circumstances.

Further, the following problems exist with a delay memory that is employed to delay data to be utilized by a program.

Where plural processes are to be performed within one sampling period, there must be provided in the delay memory plural storage areas to be used for each of the plural processes. These areas are ordinarily fixed in position and size in the delay memory. However, the areas are fixedly set taking the greatest possible data amount into consideration. Many portions of the areas are actually not used, and thus efficient use of the memory was not achieved in the prior art. For example, there is an effector called a "delay effector" for imparting a time delay to an input signal in accordance with a delay amount parameter which is typically variable over a range of 0.1 to 5,000 ms. For impartment of such a delay effect, it was conventional to allocate memory areas corresponding to the greatest possible delay amount of 5,000 ms. However, the greatest delay amount was rarely set. Very often much smaller delay amounts where actually used. Consequently, most parts of the allocated memory areas were wastefully left unused.

Of the plural processes, some may not use particular memory areas at all, while others may have to use almost every memory area. Also, it is possible that the delay time varies with the frequency of the tone to be generated. Even in such a case, however, a fixed quantity of memory areas was traditionally allocated irrespective of the frequency, and thus some memory areas allocated were undesirably wasted.

SUMMARY OF THE INVENTION

It is therefore an object of the present invention to provide an electronic musical instrument which is capable of, separately for each tone adjusting effect imparting timing and controlling effect imparting parameter generation channel.

It is another object of the present invention to provide a signal processor which is capable of selecting any of plural different processes in accordance with performance information or the like.

It is still another object of the present invention to provide a signal processor which is capable of dynamically moving a memory area to be used by a program, to achieve efficient use of the memory.

It is still another object of the present invention to provide a method of or a device for clearing a delay memory to be used by a program, without being influenced by program execution, to allow the delay memory to be used in its cleared condition for any new process.

In order to accomplish one of the above-mentioned objects, the present invention provides an electronic musical instrument which comprises a tone source for generating tone signals independently in plural channels thereof, and effect impartment sections, provided in corresponding relations to the channels, for imparting individual effects to the respective tone signals of the channels generated by the tone source section, each of the effect impartment sections controlling a parameter of the effect to be imparted to the tone signal of the corresponding channel in accordance with tone control information peculiar to the tone signal of that channel.

According to the electronic musical instrument thus arranged, it is possible to independently impart an optional effect for each channel and to control the parameter of the effect to be imparted in accordance with tone control information peculiar or unique to the tone signal generated in that channel, thus permitting effect impartment with variety. Also, effect impartment rich in expression can be achieved by diversified effect control based on the tone-specific control information.

As an example, the tone control information for controlling the effect parameter may comprise at least one of key-on and key-off signals, velocity signal and envelope signal, and the effect parameter to be controlled may be at least one of plural factors such as reverberation time and feedback coefficient of a flanger effect. Where the effect to be imparted is a modulation-based effect (such as chorus or flanger) or a delay-based effect (such as echo or reverberation), a signal delaying memory is used in the effect impartment section. In this case, if a tone generating process is performed to initiate generation of a new tone in any of the channels immediately after a damping process has been performed to rapidly deaden the preceding tone generated in the same channel, delayed tone signal of the preceding tone is left in the signal delaying memory. Therefore, when the tone signal of the new tone is delayed using the same memory, the preceding tone's delayed signal will undesirably be mixed into the new tone's signal. In view of this disadvantage, the present invention operates in the following manner. Namely, when a damping (or truncating) process is to be performed in any of the channels of the tone source, the effect impartment section switches the storage area of the signal delaying memory to be used for the channel, to another storage area which is not in use. This allows the unused storage area of the signal delaying memory to be newly used when the new tone signal is generated, so that the preceding tone's signal will not be mixed into the new tone's signal.

The above-mentioned concept can be applied to a stand-alone effector as well. Namely, the present invention provides an effector which comprises: an effect impartment section, including a storage section having at least two storage areas to be used for delaying tone sample data, the effect impartment section performing a delaying process to sequentially delay plural sample data of a tone by use of one of the storage areas, so as to impart a predetermined effect to the tone on the basis of the delaying process; an input section for inputting into the effect impartment section tone sample data to which an effect is to be imparted; a supply section for supplying control information indicating that tone generation for first tone sample data previously inputted to the effect impartment section via the input section should be damped so as to allow second tone sample data to be next inputted to the effect impartment section in place of the first tone sample data; and a control section responsive to the control information for stopping the use of one of the two storage areas which has been used for the delaying process of the first tone sample data, so as to allow the other storage area to be used for the delaying process of the second tone sample data.

An effector according to another aspect of the present invention comprises: an effect impartment section for imparting tonal effects individually for plural channels, the effect impartment section including storage areas to be used for delaying tone sample data of each of the channels separately from the other channel, the number of the storage areas being greater than the number of the channels at least by one, the effect impartment section performing a delaying process to sequentially delay plural sample data of a tone for any one of the channels by use of one of the storage areas, so as to impart a predetermined tonal effect to the tone on the basis of the delaying process; an input section for inputting tone sample data into the effect impartment section individually for the plural channels; and a control section for, when new tone sample data is inputted for a specific one of the channels via the input section, allocating an unused one of the storage areas for the specific channel so that the unused storage area is newly used for the delaying process of the new tone sample data.

In order to accomplish another one of the above-mentioned objects, the present invention also provides: a signal processor which comprises a program memory section for storing a program; a data storage section having an storage area to be used for storing data associated with execution of the program; an instruction section for instructing a change of the storage area to be used for the program; a storage area change section for, in accordance with an instruction from the instruction section, changing the storage area to be used for the program; and a program execution section for reading out the program from the program memory section and, in accordance with the read-out program, performing signal processing by use of the changed storage area.

According to the signal processor thus arranged, the storage area to be used for storing data associated with execution of the program is optionally varied rather than being fixed. That is, the position and size of the storage area in the data storage section is changed as desired, and hence it is possible to make efficient use of the data storage section.

In order to accomplish another one of the above-mentioned objects, the present invention also provides: a signal processor which comprises a performance information supply section for supplying performance information; a program selection section for, in accordance with the performance information supplied by the supply section, selecting a program to generate or process a tone signal; a storage area allocation section for variably allocating a storage area to be used for storing data associated with execution of the program selected by the selection section; and an operation section for, in accordance with the selected program, performing an operation to generate or process a tone signal by use of the storage area allocated by the allocation section.

In the signal processor, because of the arrangement that a program is selected in accordance with performance information, a program to generate or process a tone signal is automatically selected or modified in accordance with any of various performance information such as a key-on signal, velocity signal, key code or tone color information, thus permitting tone generation or tone processing with variety.

In order to accomplish another one of the above-mentioned objects, the present invention also provides: a signal processor which comprises a program memory section for storing a program for signal processing; a data storage section including plural storage areas to be used for storing data associated with execution of the program; a program execution section for reading out the program from the program memory section; and in accordance with the read-out program, performing signal processing by use of at least one of the storage areas, a clearing instruction section for instructing at least one of the plural storage areas which is not used in execution of the program to be cleared; and a clearing section for clearing the storage area instructed by the instruction section at a timing when the program execution section is not accessing the data storage section.

According to the signal processor thus arranged, unnecessary stored contents of the already used storage area in the data storage section can be cleared in an efficient manner without being influenced by the currently executed program accessing the data storage section.

Embodiments of the present invention also provides: a signal processor which comprises a performance information supply section for supplying performance information; a program memory section for storing plural programs, each implementing a different signal processing algorithm; a program selection section in accordance with the performance information supplied by the supply section for, selecting from among the plural programs a specific program to generate or process a tone signal; a program readout section for reading out, from the program memory section, the specific program selected by the selection section; and an operation section for performing an operation to generate or process a tone signal in accordance with the program read out by the program readout section.

For better understanding of the above and other features of the present invention, the preferred embodiments of the invention will be described in detail below with reference to the accompanying drawings.

DETAILED DESCRIPTION OF THE PREFERRED EMBODIMENTS

Figure 2:
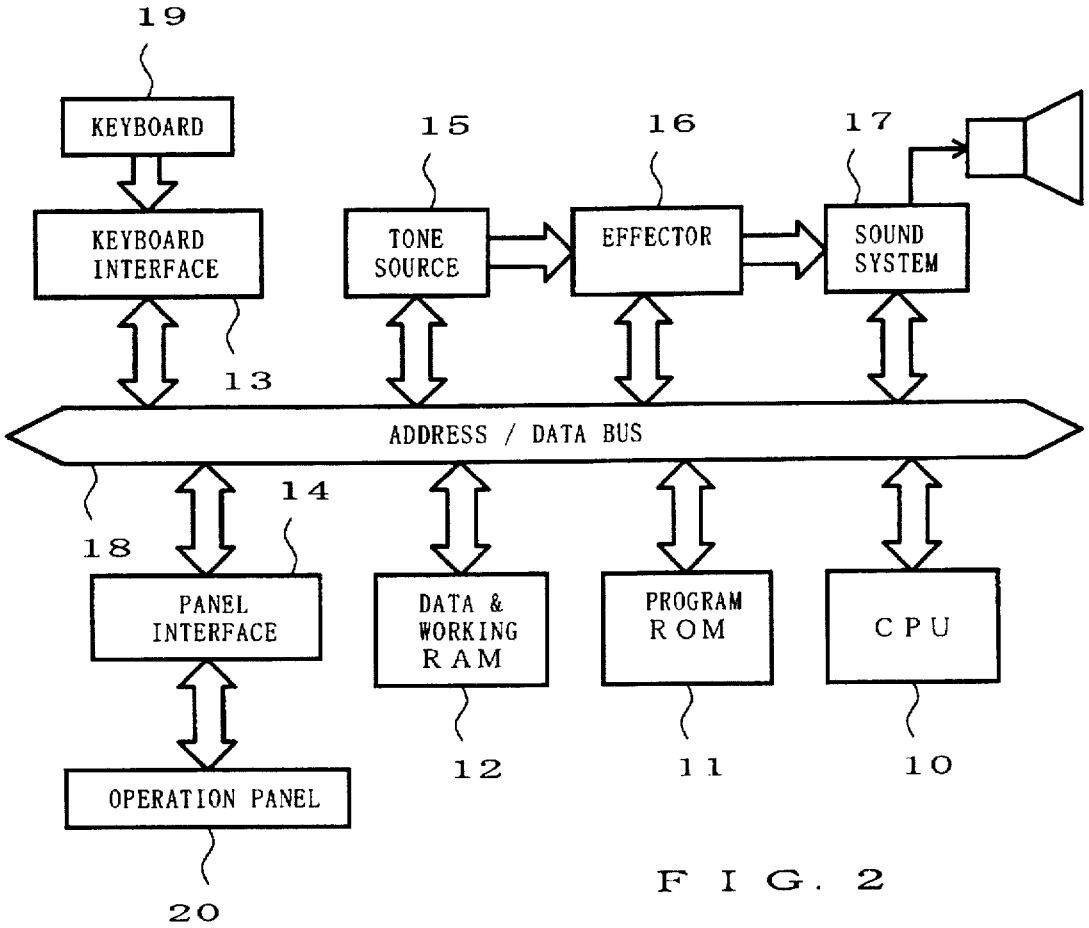
FIG. 2 is a block diagram illustrating the general hardware structure of the electronic musical instrument of FIG. 1.

FIG. 2 is a block diagram illustrating the general hardware structure of an electronic musical instrument in accordance with an embodiment of the present invention. In this embodiment, the entire electronic musical instrument is controlled by a microcomputer including a microprocessor unit (CPU) 10, a program ROM 11 and a data and working RAM 12.

The CPU 10 controls the entire operation of the electronic musical instrument. To this CPU 10 are connected, via an address and data bus 18, the program ROM 11, data and working RAM 12, a keyboard interface 13, a panel interface 14, a tone source 15, an effector 16 and a sound system 17.

The program ROM 11, which is a read-only memory, stores therein system programs for the CPU 10, various tonal parameters (effect-related microprograms) and various other data.

The data and working RAM 12 is allocated in predetermined address areas of a random access memory for use as registers and flags for temporarily storing various data which are produced as the CPU 10 executes the programs.

The keyboard 19 has a plurality of keys for designating the pitch of each tone to be generated and key switches provided in corresponding relations to the keys. If necessary, the keyboard 19 may also include key-touch detection means such as a key depression velocity or force detection device. The keyboard 19 is employed here just because it is a fundamental performance operator which is easy for music players to manipulate, but any other suitable performance operator may of course be employed.

The keyboard interface 13, which comprises circuitry including a plurality of key switches corresponding to the keys on the keyboard 19, outputs key-on event information containing the key code KC of a newly depressed key upon detection thereof and key-off event information containing the key code KC of a newly released key upon detection thereof. The keyboard interface 13 also generates key touch data IT by determining the key depression velocity or force and outputs the generated touch data as velocity data.

An operation panel 20 comprises a variety of operators or operating members for selecting, setting and controlling the color, envelope, effect, etc., of tone to be generated. The panel interface 14 detects which of the operating members is operated on the operation panel 20. Thus, in this embodiment, parameters for the tone source 15 and effector 16 are set by the microcomputer in accordance with the tone color and effect selected via the operation panel 20. In this case, the type of effect to be imparted may be made selectable separately for each channel, or alternatively, an effect may be made selectable in accordance with a designated tone color in such a manner that the type of an effect to be imparted to each channel is determined in correspondence to a tone color assigned to the channel.

The tone source 15 has a plurality of tone generation channels (32 channels in this embodiment), by means of which it is capable of generating plural tones simultaneously. The tone source 15 receives performance information (key code KC, key-on signal KON, touch data IT, various parameters TC, EG, EF) supplied via the address and data bus 18; and on the basis of the received data, it generates tone signals. Any tone signal generation method may be used in the tone source 15 depending on an application intended. For example, any conventionally known tone signal generation method may be used such as: the memory readout method where tone waveform sample value data stored in a waveform memory are sequentially read out in accordance with address data that change in correspondence to the pitch of tone to be generated; the FM method where tone waveform sample value data are obtained by performing predetermined frequency modulation operations using the above-mentioned address data as phase angle parameter data; or the AM method where tone waveform sample value data are obtained by performing predetermined amplitude modulation operations using the above-mentioned address data as phase angle parameter.

The effector 16 receives the tone signal from the tone source 15 to impart thereto an effect set via the operation panel 20 and outputs the effect-imparted tone signal to the sound system 17.

The sound system 17 comprises amplifiers and speakers, through which the effect-imparted tone signal from the effector 16 is audibly reproduced or sounded. The sound system 17 also controls the volume, localization, etc. of the tone to be sounded, in accordance with instructions given from the CPU 10.

Figure 1:
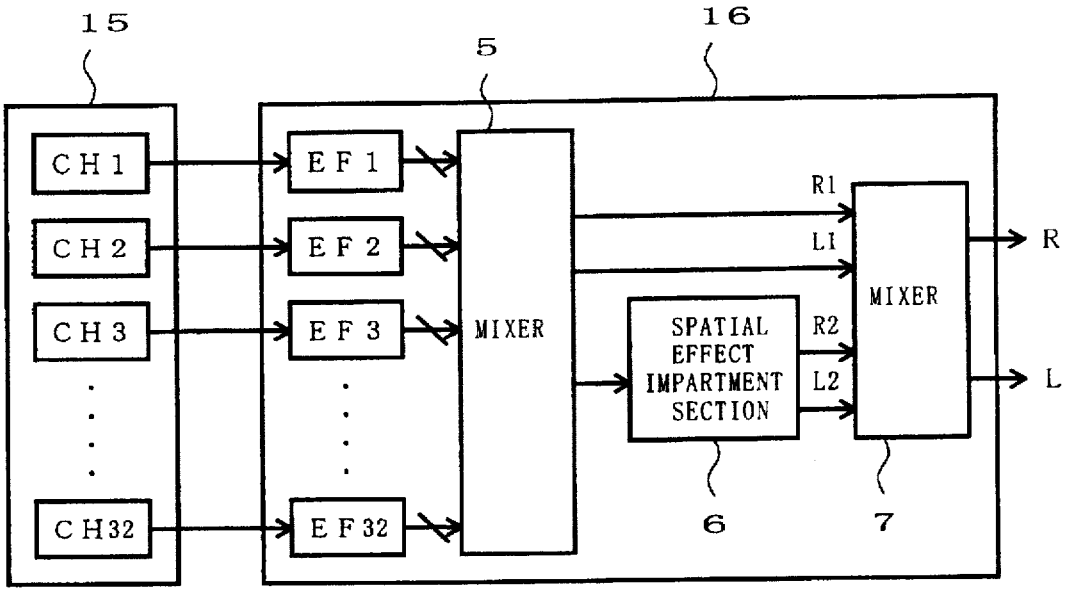
FIG. 1 is a block diagram illustrating a detailed structural example of a tone source and an effector provided in an electronic musical instrument according to an embodiment of the present invention.

FIG. 1 is a block diagram illustrating the detailed structure of the tone source 15 and effector 16 of FIG. 2. The tone source 15 outputs tone signals for 32 channels (first to thirty-second channels CH1 to CH32) to respective effect impartment sections EF1 to EF32 of the effector 16. In addition to the effect impartment sections EF1 to EF32 for 32 channels, the effector 16 includes a first mixer 5, a spatial effect impartment section 6 and a second mixer 7.

Each of the effect impartment sections EF1 to EF32 separately imparts an optional effect to the signal from the corresponding channel CH1–CH32 and then provides the resultant effect-imparted signal to the first mixer 5. Specifically, at this time, each of the effect impartment sections EF1 to EF32 performs an effect imparting process as dictated by a key-on or key-off signal, velocity signal, envelope signal, etc., for the corresponding channel CH1–CH32 which are supplied via the address and data bus. But, there may be some effect impartment sections which do not perform the effect imparting process as dictated by these signals.

For example, where the type of an effect to be imparted in a given effect impartment section is a reverberation effect, the effect impartment section varies the reverberation time in accordance with the velocity signal for the corresponding channel, generates a reverberated tone in response to the key-on signal for the channel, performs a damping process in response to the key-off signal, etc. Namely, where the velocity signal is of relatively high intensity, the reverberation time is made long, while where the velocity signal is of low intensity, the reverberation time is made short.

Where the type of an effect to be imparted in a given effect impartment section is a flanger effect, the effect impartment section controls the delay time of a comb filter in accordance with the envelope signal, and controls the feedback coefficient for the comb filter in accordance with the velocity signal, etc. Further, where the type of an effect to be imparted is an exciter effect, the effect impartment section controls the depth of the effect in accordance with the velocity signal, etc; and where the type of an effect to be imparted is a pitch change, the effect impartment section controls the detune amount of the effect in accordance with the envelope or velocity signal, etc.

The first mixer 5 mixes the effect-imparted tone signals output from the effect impartment section EF1 to EF32 in optional combinations and supplies the second mixer 7 with the thus-mixed tone signals as tone signals for right and left channels R1 and L1. The spatial effect impartment section 6 imparts a predetermined spatial effect to the mixed tone signals from the first mixer 5 and supplies the second mixer 7 with the spatial-effect-imparted signals as tone signals for right and left channels R2 and L2.

The second mixer 7 mixes, using predetermined coefficients, the right-channel tone signals R1 and R2 supplied from the first mixer 5 and spatial effect impartment section 6 and provides the sound system 17 with the resultant mixed tone signals as ultimate tone signals for the right channel R. Similarly, the second mixer 7 mixes, using predetermined coefficients, the left-channel tone signals L1 and L2 supplied from the first mixer 5 and spatial effect impartment section 6 and provides the sound system 17 with the resultant mixed tone signals as ultimate tone signals for the left channel L.

Figure 3:
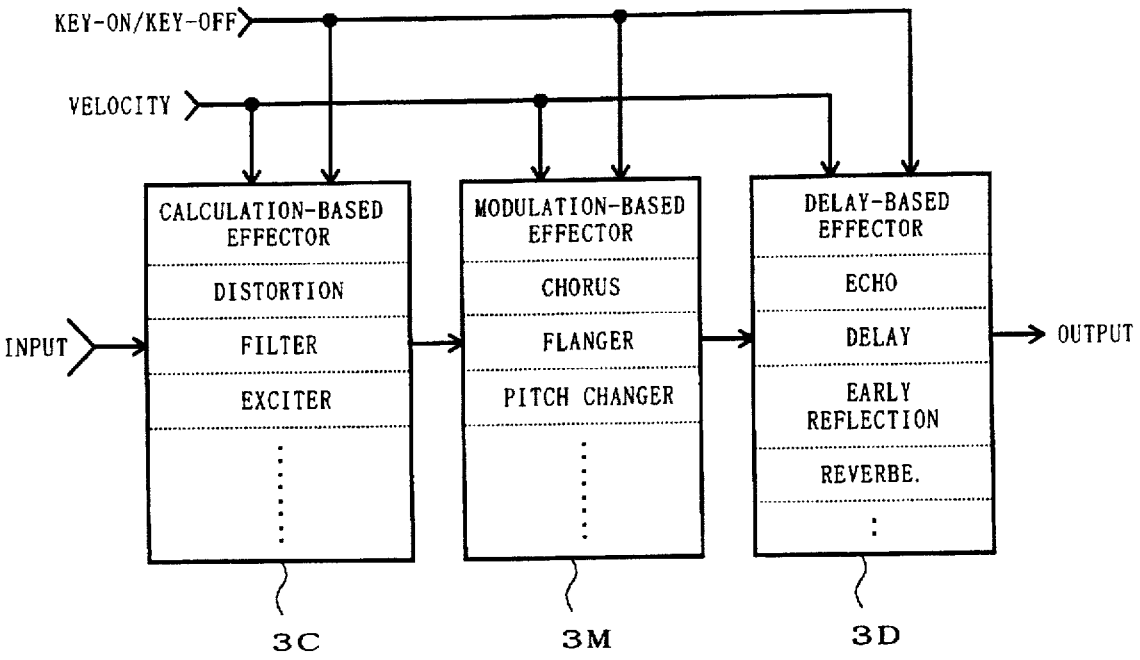
FIG. 3 is a conceptual block diagram illustrating in detail one of the effect impartment sections of FIG. 1.

FIG. 3 shows by way of example the structure of each of the effect impartment sections of FIG. 1. The effect impartment section includes a series of a calculation-based effector 3C, a modulation-based effector 3M and a delay-based effector 3D. The calculation-based effector 3C is intended for imparting effects such as distortion, filter and exciter, the modulation-based effector 3M is intended for imparting effects such as chorus, flanger and pitch change, and the delay-based effector 3D is intended for imparting effects such as echo, delay, early reflection and reverberation. In each of the effectors 3C, 3M and 3D, parameters to be used for various effect processes are controlled in real time in accordance with a key-on or key-off signal and velocity signal. The illustrated connection is just exemplary, and the effectors 3C, 3M and 3D may be in parallel connection or in a combination of parallel and serial connection with each other.

Figure 4:
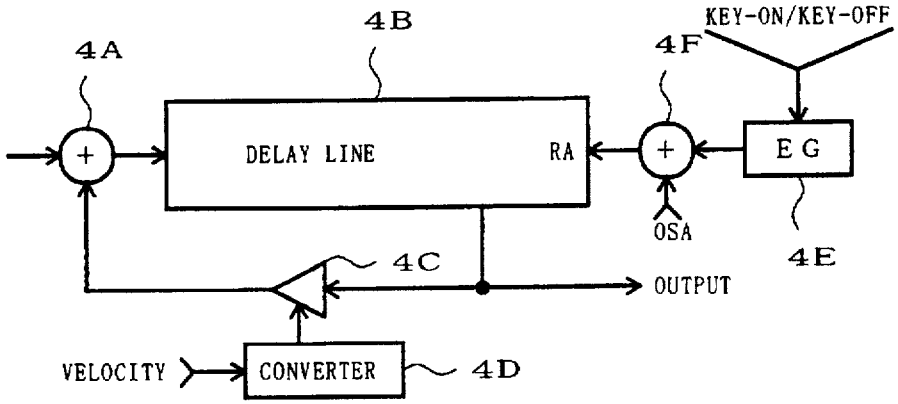
FIG. 4 is a block diagram illustrating an arrangement for achieving a flanger effect in the modulation-based effector of FIG. 3.

FIG. 4 shows a structural example of a section included in the modulation-based effector 3M for imparting the flanger effect (flanger imparting section). This flanger imparting section includes an adder 4A, a delay line 4B, a multiplier 4C, a converter 4D, an envelope generator 4E and another adder 4F. The adder 4A, delay line 4B and multiplier 4C together form a feedback loop for the flanger imparting section.

The adder 4A adds together an input signal and a feedback signal from the multiplier 4C and provides the addition result to the delay line 4B. The delay line 4B delays the addition result from the adder 4A by predetermined time corresponding to a read address RA provided from the adder 4F so as to provide the delayed signal to the adder 4C and also to the outside as a flanger-effect-imparted signal. The multiplier 4C multiplies the delayed signal from the delay line 4B by a multiplication coefficient provided from the converter 4D and provides the adder 4A with the multiplication result as the feedback signal.

In the flanger imparting section, the delay time in the delay line 4B depends on the read address RA provided from the adder 4F; namely, the delay line 4B outputs a signal stored therein at an address designated by the read address RA. Hence, the greater the value of the read address RA, the longer the delay time, and the smaller the value of the read address RA, the shorter the delay time. Because the adder 4F provides, as the read address RA, the sum of an offset address OSA and an envelope signal from the envelope generator 4E to the delay line 4B, the read address RA will vary timewise depending on the time varying sum of the envelope signal generated in response to receipt of a key-on signal and the offset address OSA. Generation of the envelope signal will be terminated in response to receipt of a key-off signal.

Further, the converter 4D receives a velocity signal to convert it into a multiplication coefficient, which is then supplied to the multiplier 4C. Thus, the multiplier 4C multiplies the delayed signal from the delay line 4B by the multiplication coefficient corresponding to the velocity signal.

As described above, in the flanger imparting section of the embodiment, various parameters (such as a feedback coefficient and delay time) are controlled in real time in response to a key-on/key-off signal and in accordance with a velocity signal. While the embodiment has been described above as varying both the feedback coefficient and the delay time, only one of these two parameters may of course be varied.

Figure 5:
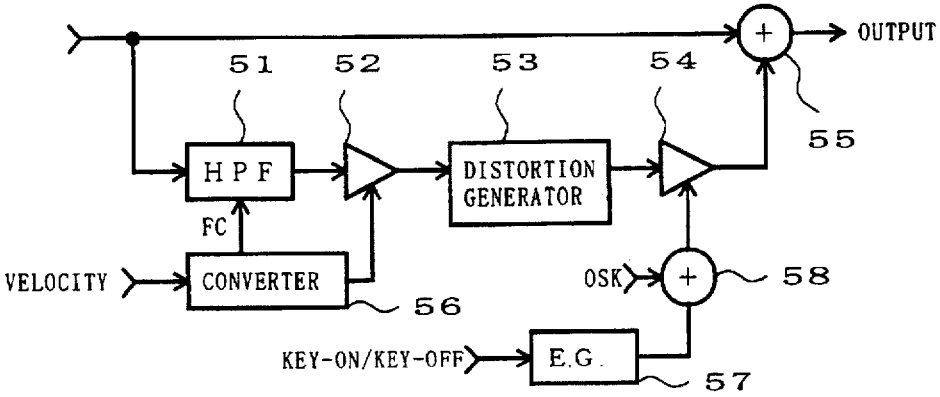
FIG. 5 is a block diagram illustrating an arrangement for achieving an exciter effect in the calculation-based effector of FIG. 3.

FIG. 5 shows a structural example of a section included in the calculation-based effector 3C for imparting the exciter effect (exciter imparting section). This exciter imparting section includes a high-pass filter (HPF) 51, a multiplier 52, a distortion generator 53, another multiplier 54, an adder 55, a converter 56, an envelope generator 57 and another adder 58.

The high-pass filter 51 permits passage therethrough of a band higher than a cutoff frequency FC provided from the converter 56 to provide the passed high-frequency signal to the multiplier 52. The multiplier 52 multiplies the high-frequency signal from the high-pass filter 51 by a multiplication coefficient provided from the converter 56 and outputs the multiplication result to the distortion generator 53. The distortion generator 53 adds harmonics to the multiplication result from the multiplier 52, through a clipping or nonlinear table conversion process, to provide the multiplier 54 with the harmonics-added distorted signal. The multiplier 54, in turn, multiplies the distorted signal from the distortion generator 53 by a multiplication coefficient provided from the adder 58 and outputs the multiplication result to the adder 55 as a feed-forward signal. The adder 55 adds together an input signal and the feed-forward signal from the multiplier 54, to provide the addition result to the outside as an exciter-effect-imparted signal.

The converter 56 receives a velocity signal and converts the received velocity signal into the cutoff frequency FC in accordance with a predetermined rule to supply it to the high-pass filter 51. The converter 56 also converts the received velocity signal into the multiplication coefficient in accordance with a predetermined rule to supply it to the multiplier 52. Accordingly, the cutoff frequency FC of the high-pass filter 51 varies in accordance with the velocity signal, and consequently the spectral distribution in the high-frequency signal passed through the high-pass filter 51 will fluctuate. Also, the multiplier 52 will multiply the high-frequency signal from the high-pass filter 51 by the multiplication coefficient corresponding to the velocity signal.

Further, in this exciter imparting section, the multiplication coefficient of the multiplier 54 is determined by the addition result of the adder 58. Namely, the adder 58 provides the sum of an offset coefficient OSK and an envelope signal from the envelope generator 57 as the multiplication coefficient to the multiplier 54, and hence the multiplication coefficient of the multiplier 54 will vary timewise in accordance with the varying sum of the offset coefficient OSK and the envelope signal generated in response to receipt of a key-on signal. Generation of the envelope signal will be terminated in response to receipt of a key-off signal. In this exciter imparting section, the feed-forward coefficient is determined by the multiplication coefficients of the multipliers 52 and 54.

As mentioned above, in the exciter imparting section of the embodiment, various parameters (such as the cutoff frequency FC and feed-forward coefficient) are controlled in real time in response to a key-on/key-off signal and in accordance with the velocity signal. While the embodiment has been described as varying both the multiplication coefficients of the multipliers 52 and 54 and the cutoff frequency of the high-pass filter 51, only at least one of these parameters may of course be varied.

Although the embodiment has been described above in relation to the case where one key depression produces one tone color, the following control is performed in a case where one key depression produces two (dual) tone colors.

That is, because the tone source 15 is capable of simultaneously generating tones in 32 channels the first to sixteenth channels CH1 to CH16 are set to produce tones of a first tone color, and the seventeenth to thirty-second channels CH17 to CH32 are set to produce tones of a second tone color. Similarly, the effect impartment sections EF1 to EF16 are set to impart an effect corresponding to the first tone color, and the effect impartment sections EF17 to EF32 are set to impart an effect corresponding to the second tone color.

When a key-on signal is output from the keyboard interface 13, the CPU 10 searches through the first to sixteenth channels CH1 to CH16 for an empty channel available for tone generation. If, for example, the fourth channel CH4 is an empty channel, the CPU 10 gives a tone generating instruction to the fourth channel CH4 and twentieth channel CH20 which is the sixteenth channel from the fourth channel CH4. The CPU 10 also provides the corresponding effect impartment sections EF4 and EF20 with effect parameters corresponding to the first and second tone colors, respectively. For example, the CPU 10 provides the effect impartment section EF4 with only a velocity signal and provides the effect impartment section EF20 with only an envelope signal. Thus, a proper effect imparting process is achieved even in the case where two tone colors are produced by one key depression.

In the event that no empty channel is found in the search by the CPU 10, a conventional truncating process is performed such that one of the channels where tone volume attenuation has progressed to the farthest degree is subjected to compulsory damping, and generation of the designated tone is assigned to that channel. But, such a truncating process is not applicable to the effect impartment sections, because for some type of effect, tone can not immediately be deadened by damping. Namely, in the case of the calculation-based effector 3C capable of providing an effect-imparted signal with no substantial time delay from reception of the input signal, tone can be deadened immediately by damping; however, in the case of the modulation-based and delay-based effectors 3M and 3D employing a delay memory such as the delay line, the preceding delayed tone remaining in the delay memory will be undesirably output for a while even after it has been processed to be deadened by the damping process in the tone source channel.

Therefore, in this embodiment, two delay memories are provided in corresponding relation to the modulation-based and delay-based effectors 3M and 3D. In this case, upon termination of damping in the tone source channel, the delay memory to be used is switched from one to the other so that always a cleared (unused) delay memory is used for a new tone. This allows the tone output from the modulation-based or delay-based effector 3M or 3D to be damped in a similar manner to the damping in the tone source channel.

Figure 6:
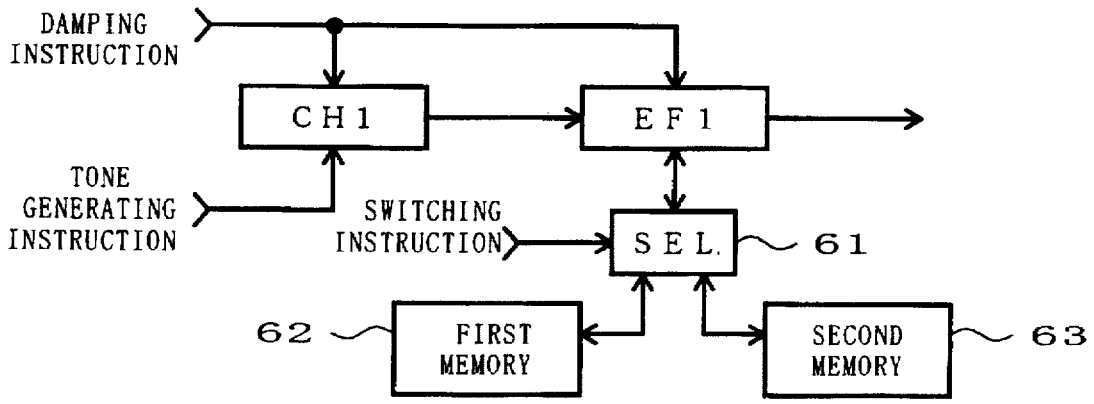
FIG. 6 is a block diagram illustrating a structural example of an effect impartment section where two delay memories are alternately used for a damping process.

FIG. 6 shows a structural example of the effect impartment section where the damping process is performed by switching the delay memory to be used, i.e., alternately using the two delay memories. In this illustrated example, tone generating and damping instructions are provided from the CPU 10 to the first channel CH1 of the tone source 15. To the effect impartment section EF1 are provided a tone signal from the first channel CH1 of the tone source 15 and the damping instruction from the CPU 10. The two delay memories (first and second memories 62 and 63) are connected to the effect impartment section EF1 via a selector 61. In response to a switching instruction from the CPU 10, the selector 61 connects either of the two delay memories 62 and 63 to the effect impartment section EF1. It is assumed here that the first memory 62 is connected to the effect impartment section EF1.

Once the first channel CH1 of FIG. 6 becomes an object of damping in a truncating process, the CPU 10 provides a damping instruction to the first channel CH1 of the tone source 15 and the effect impartment section EF1. Then, upon completion of the damping, the CPU 10 provides a tone generating instruction to the first channel CH1 of the tone source 15 and also provides a switching instruction to the selector 61, so that the unused second memory 63 is connected to the effect impartment section EF1 and the first memory 61 so far been connected to the section EF1 is disconnected therefrom. After this, tone signal to be newly generated will be written into the second memory 63, and the preceding delayed tone signal remaining in the first memory 62 will be prevented from being undesirably output.

After completion of a series of such operations, data remaining in the first first memory 62 that has been disconnected from the effect impartment section EF1 in response to the switching instruction are cleared in preparation for a next truncating process. In this way, the two delay memories 62 and 63 are used alternately in one effect channel.

Figure 7:
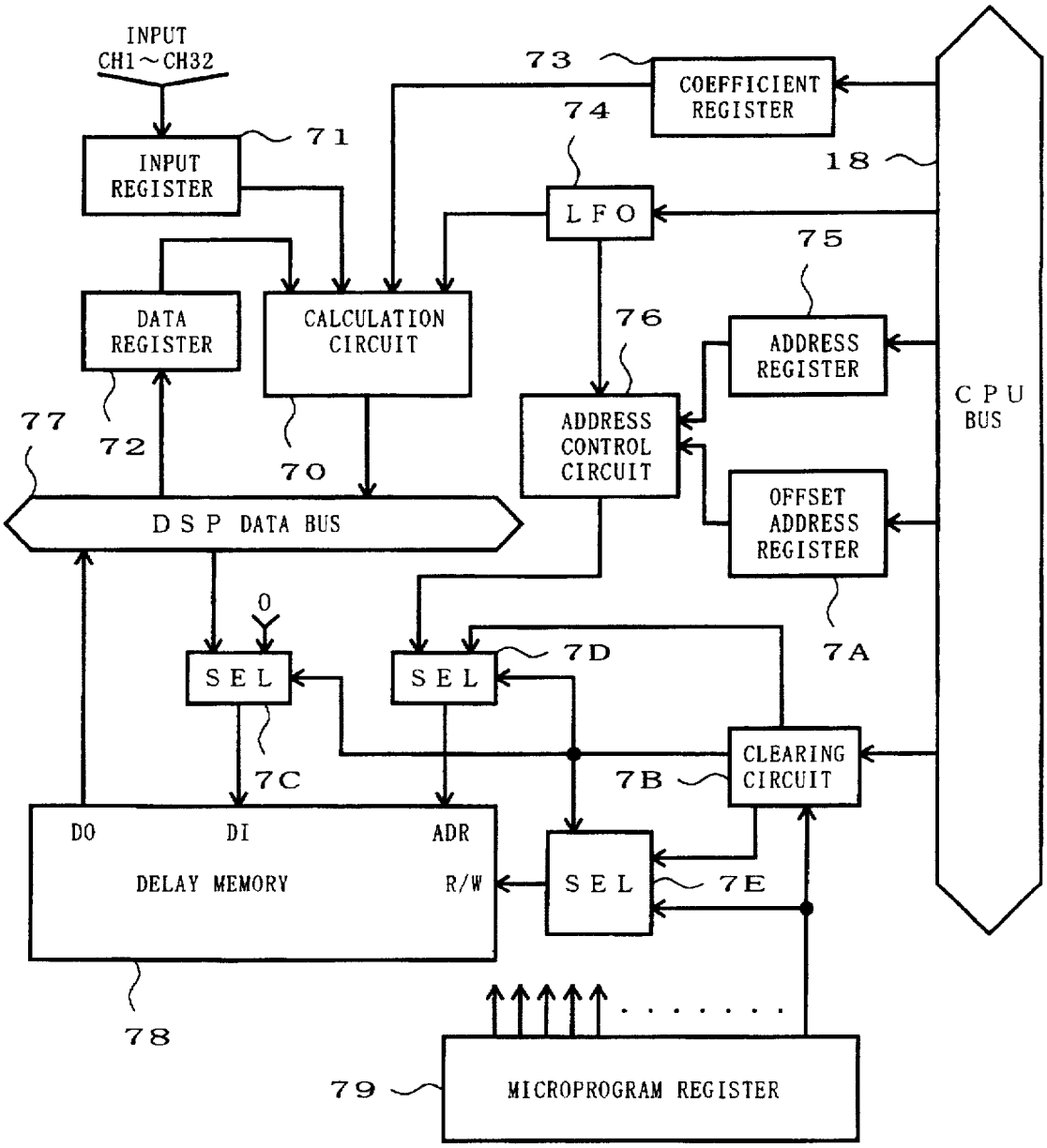
FIG. 7 is a block diagram illustrating a detailed structural example of a modified embodiment where the effector of FIG. 1 or 2 is implemented by a digital signal processor (DSP) and where two delay memories are alternately used as in the example of FIG. 6.

FIG. 7 shows a specific structural example of a modified embodiment where the effector 16 of FIG. 2 is implemented by a digital signal processor (hereinafter referred to as a DSP) and a damping process is performed by switching the delay memory to be used as in FIG. 6.

The DSP comprises a calculation or operation circuit 70, a data register 71, an input register 72, a coefficient register 73, a low frequency oscillator (LFO) 74, an address register 75, an address control circuit 76, a DSP data bus 77, an external delay memory 78, a microprogram register 79, an offset address register 7A, a clearing circuit 7B, and selectors 7C, 7D and 7E. The DSP is designed in such a manner that different effects can be imparted, through time divisional processing, to respective tone signals of 32 channels supplied from the tone source 15.

Figure 8:
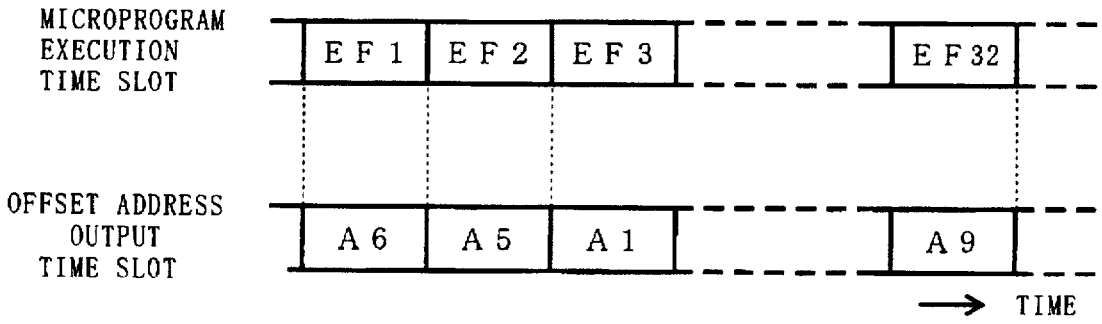
FIG. 8 is a timing chart illustrating time slots for microprogram execution and offset address output.

In the microprogram executing time slots shown in FIG. 8, the DSP carries out an effect imparting process for the effect impartment sections EF1 to EF32 corresponding to the 32 channels CH1 to CH32.

The calculation or operation circuit 70, which includes adders and multipliers, receives the respective tone signals of the individual channels CH1 to CH32 from the input register 71, data from the data register 72, coefficient data from the coefficient register 73 and a low frequency signal from the low frequency oscillator 74, so as to perform calculations on the received data and signals in accordance with microprograms supplied from the microprogram register 79.

The input register 71 receives write signals from the microprogram register 79 during a period when the tone signals of the individual channels CH1 to CH32 are being supplied thereto from the tone source 15, and the register 71 temporarily stores the received tone signals to then provide the signals to the calculation circuit 70 at predetermined timing.

The data register 72 temporarily stores a calculation result data from the calculation circuit 70 as well as delay data from the delay memory 78 and supplies these data to the calculation circuit 70. The data register 72 includes a plurality of storage areas, and addresses for writing and reading data into and from the register 72 are designated at predetermined timing by the microprograms supplied from the microprogram register 79.

The coefficient register 73 is a register for supplying a different coefficient for each of plural (n) calculations performed per sampling period by the calculation circuit 70, and the register 73 is composed of n-stage shift registers where data is shifted one cycle through the n stages per sampling period. Coefficients in the register 73 are rewritable by the CPU 10 via the CPU bus (address and data bus) 18, so that coefficients to be used for effect calculations, etc., can be varied in real time by an external controller or in accordance with velocity signal, envelope signal or the like.

The low frequency oscillator 74, which generates a triangle, sawtooth or sine wave, provides the calculation and address control circuits 70 and 76 with a modulating waveform to be used for amplitude modulation or delay time modulation.

Figure 9A:
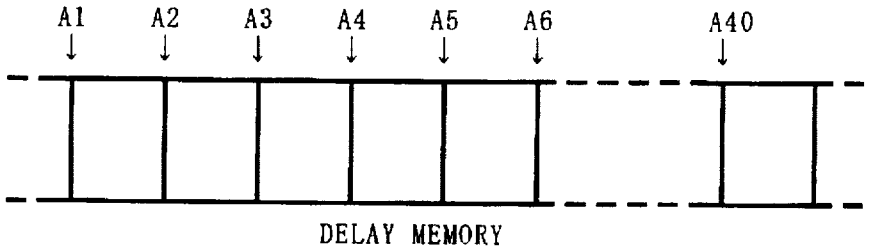
FIGS. 9A an 9B are diagrams illustrating a structural example of a delay memory of FIG. 7 and contents of an offset address register of FIG. 7, respectively.

The delay memory 78 comprises a large-capacity storage device (such as a RAM) provided outside the DSP. The DSP writes data into this delay memory 78 and creates a delay signal by reading out the written data upon passage of predetermined time. Although it is sufficient for the delay memory 78 to include 32 bank areas corresponding to the 32 tone generation channels, the delay memory 78 in this embodiment actually includes more bank areas than the number of the channels, because the embodiment is designed to perform the damping process by switching the damping area to be used. As shown in FIG. 9A, the delay memory 78 in this embodiment includes 40 bank areas composed of storage areas of a predetermined capacity. The respective start addresses of the 40 bank areas are "A1", "A2", . . . , "40".

For each of the bank areas, the address register 75 stores therein relative addresses which are set by using the corresponding start addresses "A1", "A2", . . . , "A40" as the base address "0", so as to output an address corresponding to the access timing of the microprogram register 79.

Figure 9B:
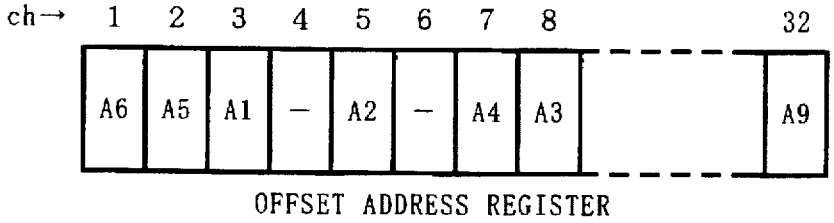

The offset address register 7A stores therein the respective start addresses of the individual bank areas for the channels CH1 to CH32. For example, where the contents of the offset address register 7A are as shown in FIG. 9B, the first channel CH1 uses, as a delay memory, the bank area whose start address is "A6"; likewise, the second channel CH2 uses the bank area whose start address is "A5", the third channel CH3 uses the bank area whose start address is "A1", the fifth channel CH5 uses the bank area whose start address is "A2", the seventh channel CH7 uses the bank area whose start address is "A4", the eighth channel CH8 uses the bank area whose start address is "A3", and the thirty-second channel CH32 uses the bank area whose start address is "A9". In the illustrated example of FIG. 9B, no bank area is allocated to the fourth and sixth channels CH4 and CH6, which means that these channels do not use any delay memory.

Thus, for each microprogram executing time slot, an offset address is supplied from the offset address register 7A to the address control circuit 76 at such timing, as shown by the offset address outputting time slots of FIG. 8. That is, the effect impartment section EF1 corresponding to the first channel CH1 performs an effect imparting process by use of the bank area whose start address is "A6". Similarly, each of the other effect impartment sections EF2 to EF32 corresponding to the second to thirty-second channels CH2 to CH32 performs an effect imparting process by use of the associated bank area whose start address is the offset address supplied from the offset address register 7A.

For example, once any of the channels has become an object of damping in a truncating process in a similar manner to the above-mentioned, the CPU 10 provides a damping instruction to the corresponding channel of the tone source 15. Then, upon completion of the necessary damping in that channel, the CPU 10 provides a tone generating instruction to the channel of the tone source 15 and also rewrites the offset address for the channel stored in the offset address register 7A. Thus, a tone signal to be newly generated will be written into another bank area in the delay memory 78, so that no tone remaining in the last-used bank area will be provided to the outside. Thereafter, the CPU 10 clears the data in the last-used bank area in preparation for a next truncating process. This clearing operation is effected, via the clearing circuit 7B, by the CPU 10 writing the start address, i.e., offset address of the last-used bank area into the clearing circuit 7B.

The address control circuit 76 adds together the relative address from the address register 75 and the offset address from the offset address register 7A to create an absolute address in the delay memory 78, and the control circuit 76 outputs the absolute address to the selector 7D. The absolute address to be thus output to the selector 7D is incremented by the control circuit 76 by one for each sampling period. Although not shown in the figure, the address control circuit 76 is also sometimes supplied with a relative address via the DSP bus 77. This occurs for example when it is necessary to obtain an address by calculation, and in such a case, an address calculated by the calculation circuit 70 is supplied to the address control circuit 76.

The microprogram register 79 stores therein microprograms corresponding to the effect impartment sections EF1 to EF32. The type of effect to be imparted can be changed by rewriting the microprogram. Because plural microprograms are prestored in the program ROM 11 connected via the CPU bus 18, the CPU 10 reads out any of the prestored programs from the program ROM 11 in response to an effect designation on the operation panel 20 and writes the readout microprogram into the microprogram register 79.

When a bank area switching takes place in the delay memory 78 in order to perform a damping process, the clearing circuit 7B and selectors 7C, 7D and 7E clear data in the last-used bank area. More specifically, the selector 7C functions to supply either data from the DSP data bus 77 or clear data (data of low level "0") to the data input terminal DI of the delay memory 78. The selector 7D supplies either an address from the address control circuit 76 or an address from the clear circuit 7B to the address terminal ADR of the delay memory 78. The selector 7E supplies either a read/write control signal from the microprogram register 79 or a write control signal from the clearing circuit 7B to the read/write terminal R/W of the delay memory 78.

The clearing circuit 7B determines whether or not an access signal (read/write control signal) has been supplied from the microprogram register 79 to the delay memory 78. If the access signal has been supplied, the selector 7C is connected to the DSP data bus 77, the selector 7D to the address control circuit 76, and the selector 7E to the microprogram register 79. Conversely, if the access signal has not been supplied, the selector 7C is connected to the clear data, and the selectors 7D and 7E are both connected to the clearing circuit 7B. Thus, the clearing circuit 7B clears the data in the last-used bank area of the delay circuit 78 for each address at suitable timing when the microprogram register 79 is not accessing the delay memory 78.

The following describes the truncating process performed by the DSP.

First, once the first channel CH1 has become an object of damping, the CPU 10 provides a damping instruction to the first channel CH1 of the tone source 15. Then, upon completion of the necessary damping process in that channel CH1, the CPU 10 provides a tone generating instruction to the channel CH1 and also rewrites the offset address "A6" into the offset address of any of the other already-cleared bank areas in the delay memory 78, say, "A10". Thus, a tone signal to be newly generated will be written into the bank area to which the offset address "A10" is allocated.

Then, the CPU 10 writes the start address of the last-used bank area into the clearing circuit 7B, and the clearing circuit 7B clears the data in the last-used bank area of the delay circuit 78 for each address by switching the selectors 7C, 7D and 7E at suitable timing when the microprogram register 79 is not accessing the delay memory 78. After that, upon completion of the clearing operation, the clearing circuit 7B provides the CPU 10 a clearing operation completion signal. If there is still any other bank area requiring data clearing, the CPU 10 similarly writes the start address of that bank area into the clearing circuit 7B to cause the circuit 7B to perform a clearing operation. By switching the bank area of the delay memory 78 to be used in the truncating process as mentioned above, the DSP can avoid the inconvenience that tone is undesirably outputted for a while even after a damping operation is applied to the tone source channel.

In another embodiment of the invention, the memory 78 may be designed to have bank areas, the number of which is greater than the number of channels at least by one, so that at least one of the bank areas is placed in empty (available) condition even when tones are being generated in all the channels. In this case, the correspondency between the channels and bank area may be made variable in such a manner that when a new tone is generated in any of the channels, the empty bank area is allocated for effect processing for that channel irrespective of presence or absence of damping.

As has been described so far, the present invention can adjust effect imparting timing and control effect imparting parameters separately for each tone generation channel.

Next, with reference to FIGS. 10 to 17, a description will be made on an embodiment of a signal processor in accordance with the present invention.

Figure 12:
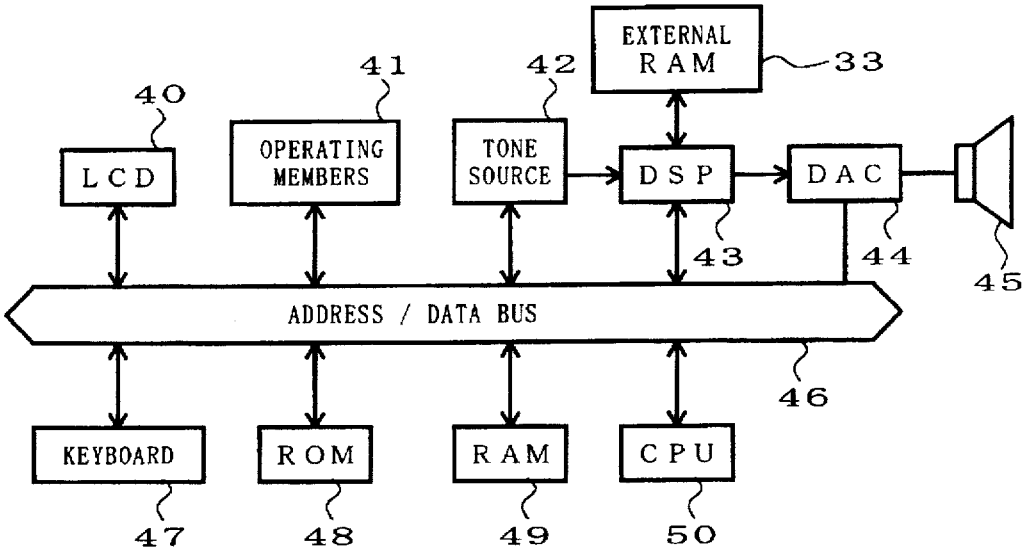
FIG. 12 is a block diagram illustrating an embodiment of an electronic musical instrument containing the signal processor of FIG. 10.
Figure 13:
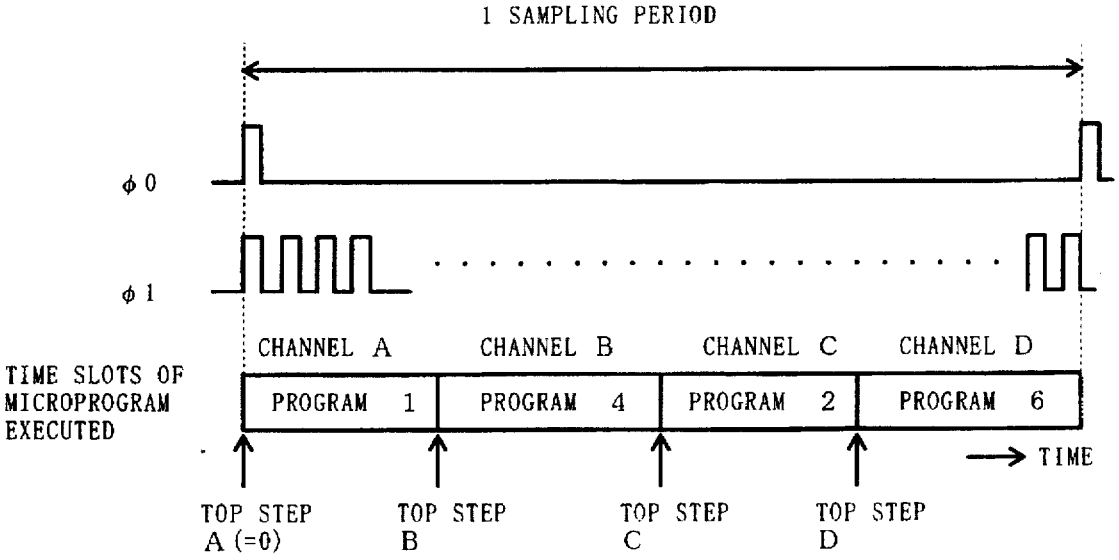
FIG. 13 is a time chart illustrating an example of an operation of the signal processor of FIG. 10.
Figure 14:
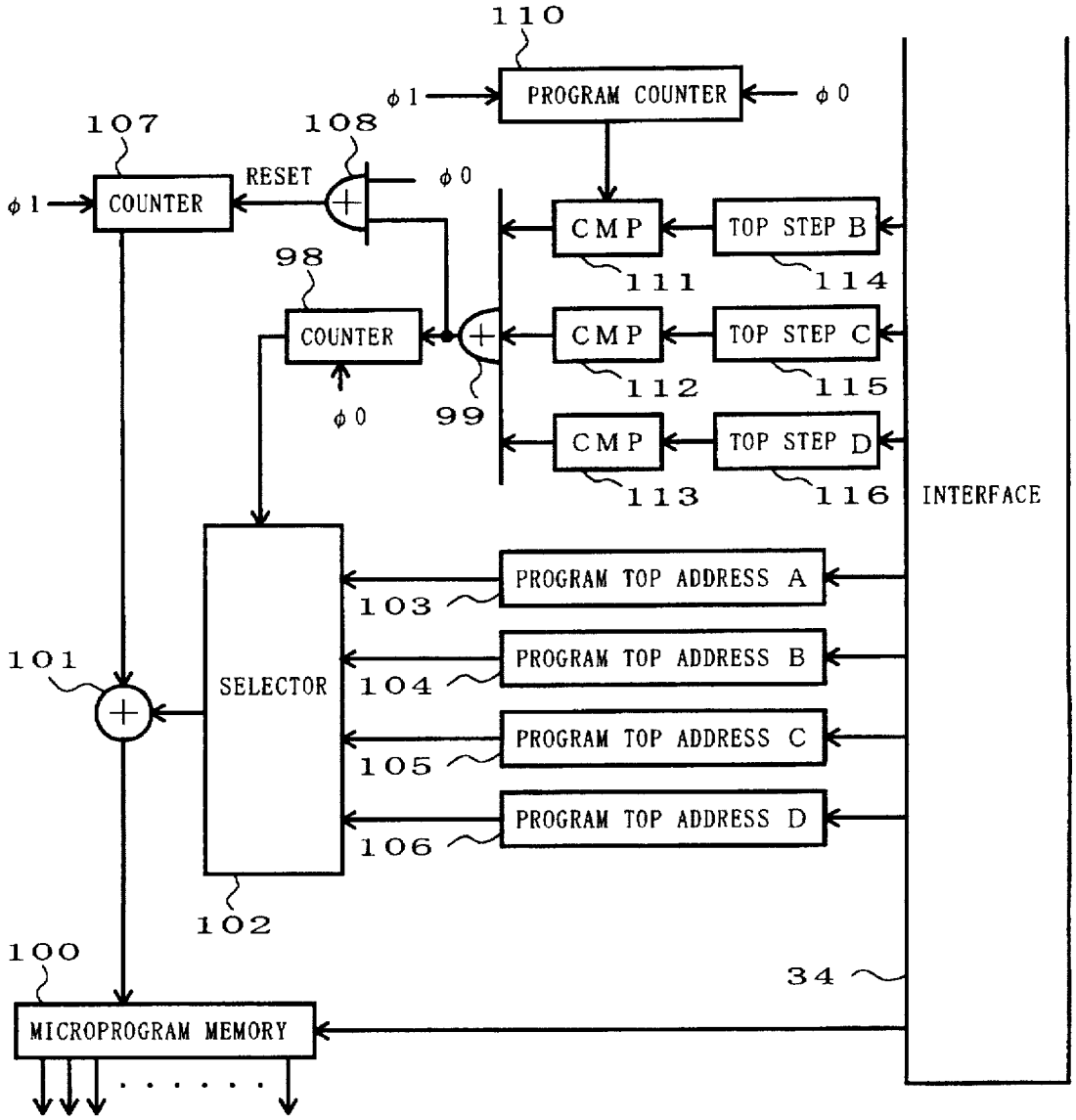
FIG. 14 is a block diagram illustrating an example of a microprogram memory section in the signal processor of FIG. 10.

FIG. 12 is a block diagram illustrating the general hardware structure of an electronic musical instrument that is provided with the signal processor in accordance with the present invention. In this electronic musical instrument, tone generation, effect impartment, etc., are controlled by a microcomputer.

To an address and data bus 46 are connected a CPU 50, a RAM 49, a ROM 48, a keyboard 47, an LCD 40, operating members 41, a tone source 42, a DSP 43 and the like.

The keyboard 47 includes a multiplicity of keys, and when any of the keys is operated by the player, the key operation is detected as key operation information. Instead of employing the keyboard 47 as performance information inputting means, performance information may be inputted from a MIDI instrument to a MIDI-standard-based performance information receiving device connected to the address and data bus 46.

In accordance with programs stored in the ROM 48, the CPU 50 performs various processes for tone generation, effect impartment and the like. For tone generation, the CPU 50 performs processes to detect each depressed key on the keyboard 47 and to supply the tone source 42 with tone pitch information and key-on signal of the depressed key for generation of a digital tone signal thereby.

The tone source 42 includes a plurality of tone generation channels for respective digital tone signals or exciting waveform signals. The tone signals generated from these channels are divisionally supplied to the DSP 43. When plural keys are simultaneously depressed on the keyboard 47, tone pitch information and key-on signals associated with these depressed keys are supplied to plural tone generation channels, which in turn simultaneously generate respective tone signals.

Each tone signal or exciting waveform signal thus generated by the tone source 42 is sent to the DSP 43, which performs tone generating and effect imparting processes. An external RAM 33 is used for data write and read purposes in accordance with instructions by microprograms contained within the DSP 43. The operation of the DSP 43 and external RAM 33 will be later described in detail.

Each tone signal processed by the DSP 43 is outputted to a digital-to-analog converter (DAC) 44, from which the resultant converted analog signal is sent to a sound system 45. The sound system 45, which is composed of amplifiers and speakers, amplifies the analog signal to a predetermined level so as to acoustically reproduce or sound the amplified signal through the speakers.

Figure 11:
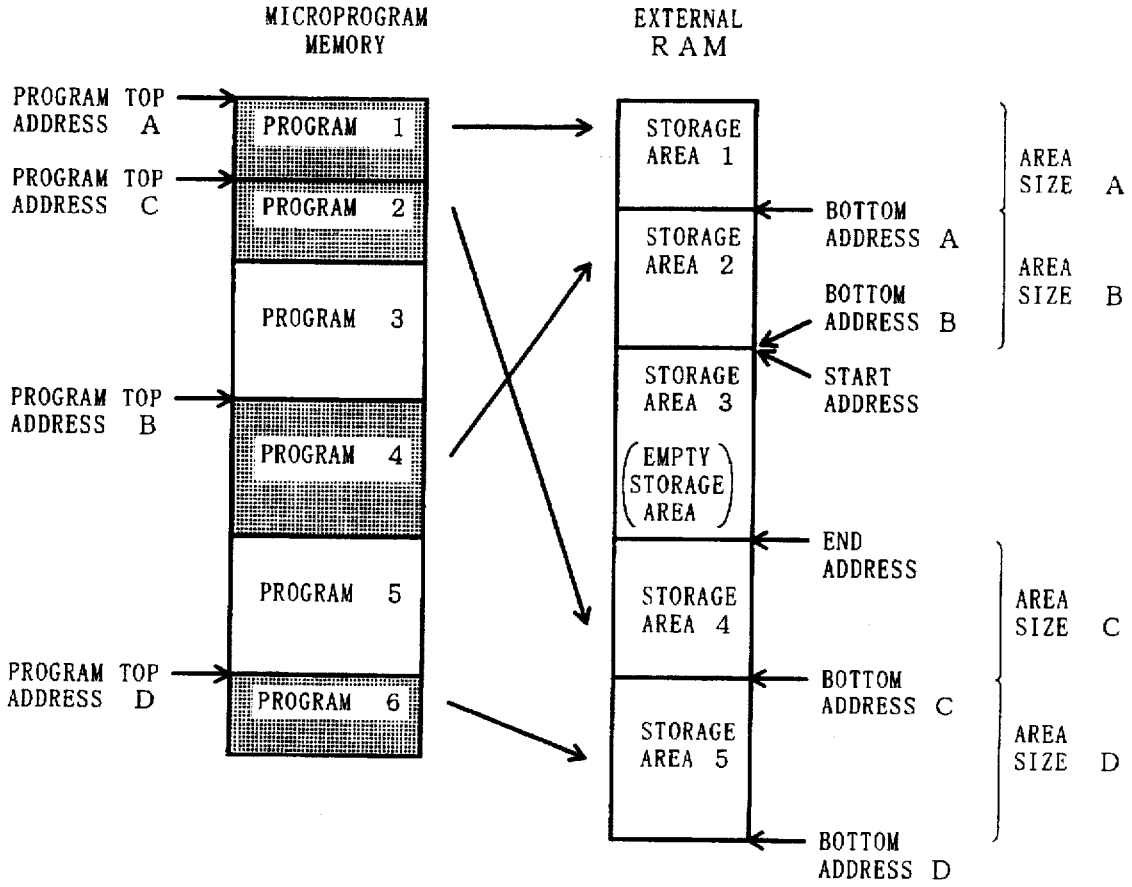
FIG. 11 is a diagram illustrating the stored contents of a microprogram memory and external RAM of FIG. 10.

FIG. 11 is a diagram explanatory of the operation of the signal processor of the invention, which shows plural storage areas in the external RAM 33 that are used by plural programs stored in a microprogram memory provided within the DSP 43. In the illustrated example, six programs are stored in the microprogram memory. These six programs are ones which have been selected in accordance with instructions by the CPU 50 from among a multiplicity of programs stored in the ROM 48 and transferred to the microprogram memory. Although it is assumed in this embodiment that the number of program steps executable per sampling period by the DSP 43 is 512, the microprogram memory may have a storage capacity to store more than 512 steps, because it is necessary to previously load therein such a program that may have to be allocated instantaneously.

The programs transferred to the microprogram memory which are to be actually executed are chosen such that a total number of program steps is 512 or less. Further, a same program may be repeatedly executed any desired number of times within one sampling period, and the order to execute the programs may be varied as desired. It is assumed that the maximum number of programs executable within one sampling period is four, although any desired combinations of the programs are possible.

In the illustrated microprogram memory of FIG. 11, programs each denoted in a shaded block (i.e., programs 1, program 2, program 4 and program 6) are the ones to be actually executed, and areas in the external RAM 33 which are used by such programs are indicated by arrows. The external RAM 33 includes five storage areas, and as indicated by the arrows, storage area 1 is used by program 1, storage area 2 by program 4, storage area 4 by program 2 and storage area 5 by program 6. Storage area 3 in the external RAM 33 is shown here as an empty area that is not being used by any of the programs.

The size of each of these storage areas in the external RAM 33 is variable depending on various situations, and it is possible to freely set which program uses which storage area. It is also possible to change the position of the storage area used by a specific program. For example, where program 1 is a delay effect program, the size of storage area 1 can be dynamically varied in accordance with a delay amount that is preset or designated via a predetermined operating member 41. Further, where program 4 includes a tone source program composed of an algorithm containing a feedback loop, a specific storage area, such as storage area 2, having been so far used can be dynamically changed to cleared storage area 3.

Figure 10:
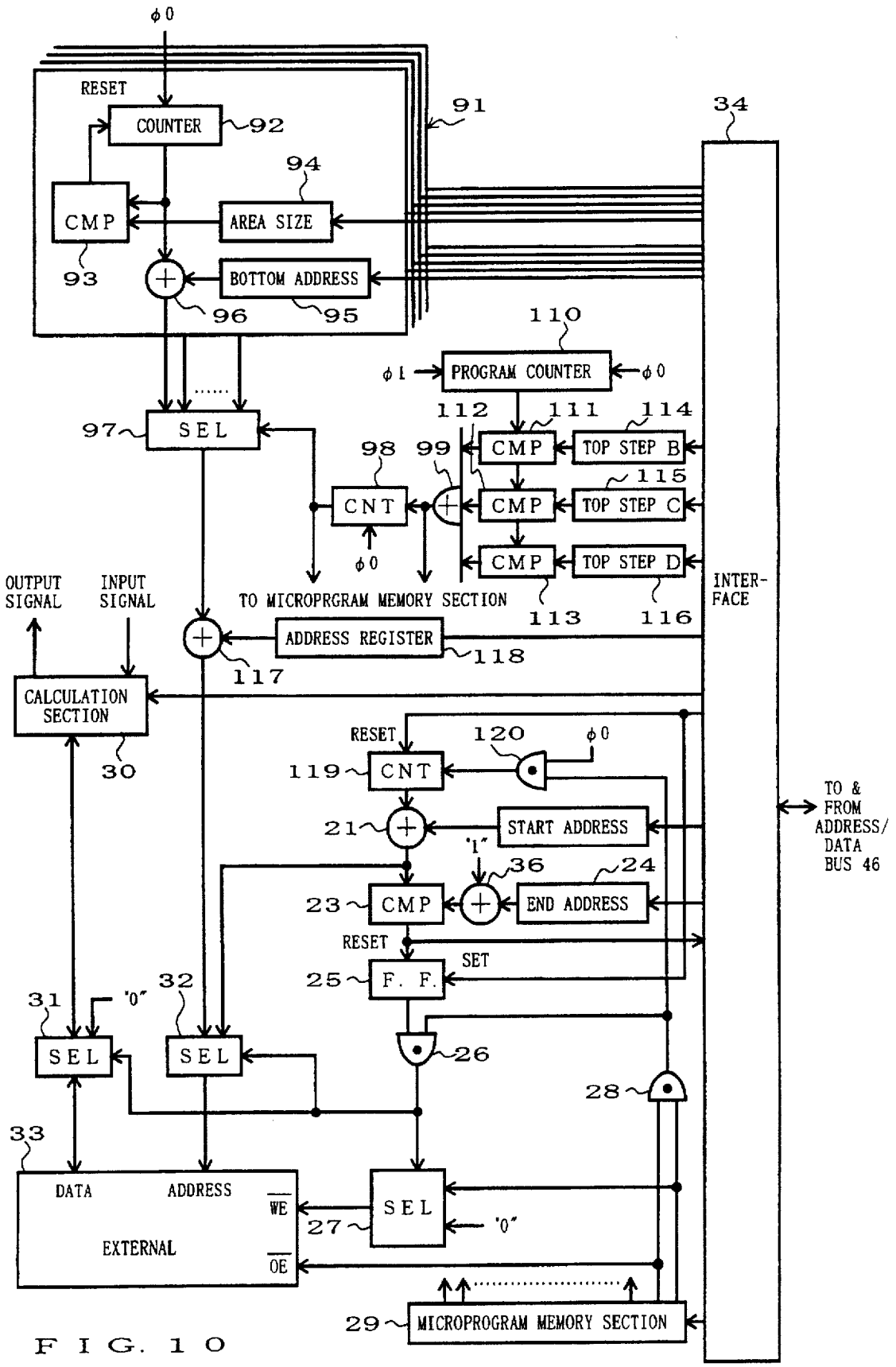
FIG. 10 is a block diagram illustrating an embodiment of a signal processor in accordance with the present invention.

FIG. 10 shows the inner structure of the signal processor embodiment of the present invention, in which there are provided a plurality of address counters 91 each comprising a counter 92, a comparator 93, an area size register 94, a bottom address register 95 and an adder 96. The total number of the address counters 91 is equal to the number of channels executable per sampling period. It is possible to allocate desired programs to the individual channels A to D and to cause these allocated programs to be executed simultaneously. In the embodiment, there are four channels at the maximum, and channels A, B, C and D are sequentially executed from the beginning of one sampling period.

Programs to be allocated to such channels are freely selectable from among the programs stored in the microprogram memory. FIG. 3, shows that the programs allocated to the individual channels are sequentially executed within one sampling period. From the fact that program 1 is allocated to channel A, program 4 to channel B and program 2 to channel C, it is seen that the order of the programs to be allocated has no relation to the order in which the programs are stored in the microprogram memory. Further, although program 6 is shown here as allocated to channel D, this program 6 may be replaced by program 4 already executed in channel B.

It is possible to freely set the order and number of times of execution of the programs as mentioned above, but the program allocation must be done with care so that the total number of steps of the programs allocated to the individual channels will not exceed the total number of steps executable per sampling period. Even where the total number of steps of the allocated programs is less than the number of the executable steps, care must taken so that a program allocated to a specific channel will not be executed before another program allocated to the preceding channel is completely executed to its end. This is achieved under the control of the CPU.

Referring to FIG. 10, the counter 92 is supplied with clock $\phi 0$ having a period corresponding to the sampling period so that the counter 92 increments its count per sampling period. The output counted value from the counter 92 is fed to the adder 96 in the form of 2's complement, as well as to the comparator 93. The comparator 93 is also supplied with the size value of one of the plural storage areas from the area size register 94. Once the output value from the counter 92 coincides with the area size, the comparator 93 outputs a signal to reset the counter 92. That is, the counter 92 is reset to "0" once it outputs a count coinciding with the area size, and the counter 92 in effect repeats its counting from its initial count "0" to a maximum count corresponding to the area size value minus one.

The adder 96 adds together the output value from the counter 92 and the bottom address of each of the storage areas from the bottom address register 95. Because the output from the counter 92 is in 2's complement, the adder 96 in effect subtracts the output counted value of the counter 92 from the bottom address so as to output the result to the selector 97.

Via an interface 34, the CPU 50 writes into the plural address counters 91 the respective sizes and bottom addresses of the storage areas to be used by the programs allocated to the individual channels.

The output counted value of each of the address counters 91 is delivered to the selector 97, and a select signal to the selector 97 is controlled to allow a selection to be made during operation of the allocated program. The select signal is given from the counter 98. Clock $\phi 0$ rising at the outset of one sampling period is supplied as a reset signal to the counter 98, which thus outputs "0" at the outset of the sampling period. Clock $\phi 0$ is also applied as a reset signal to a program counter 110, which is thus reset to "0" at the outset of the sampling period. To the program counter 110 is also applied clock $\phi 1$ whose period corresponds to the execution time of one program step. If the total number of microprogram steps is 512, then clock $\phi 1$ will have a period that is 1/521 of the sampling period.

The output value of the program counter 110 is fed to an address register 118 and microprogram memory section 29 as well as to comparators 111, 112 and 113. To these comparators 111, 112 and 113 are also applied, from associated top step registers 114, 115 and 116, starting steps at which execution of the programs allocated to the individual channels is started. In this embodiment, although the number of programs executed within one sampling period is assumed to be four, the number of the top step registers is three. This is because no top register is necessary for channel A since the starting step of the first channel A is "0" and the counter 98 is reset by clock $\phi 0$.

Via the interface 34, the CPU 50 writes the respective starting steps of the programs allocated to channels B, C and D into the top step registers 114, 115 and 116. From this, it can be seen that the boundary between the channels may also be set freely. This is necessary for making efficient use the DSP without limiting the size of the programs to be allocated.

Once the output value of the program counter 110 becomes coincident with the starting step of any of the allocated programs, any of the comparators 111, 112 and 113 outputs a coincidence signal, which is then passed via an OR circuit 99 to the counter 98. In this way, the counter 98 counts at the boundary of the channels, so that in response to the counted result, the selector 97 sequentially selects the outputs of the plural address counters corresponding to the channels. Thus, the respective addresses of the storage areas of the external RAM 33 that are used by the programs allocated to the channels will be changed in response to execution of each of the channels.

The output value of the address counter 91 corresponding to each channel selected by the selector 97 is added by an adder 117 to the output value of the address register 118. The address register 118, which has addresses corresponding to the total number of microprogram steps 512, is accessed for address readout by using the output value of the program counter 110 as a read address. The readout from the address register 118 is done in synchronism with data readout from the microprogram memory section 29. Each address stored in the address register 118 is one for accessing the external RAM 33, and this address is stored in the form of a relative address which is set by using, as the base address "0", the start address of the corresponding storage area of the external RAM 33. The output from the address register 118 is added by the adder 117 to the output value of the address counter 91 to provide an actual or absolute address for accessing the external RAM 33.

Calculation (or operation) section 30 comprises a multiplier, an adder, and a coefficient register for supplying a coefficient necessary for multiplication. The calculation section 30 performs predetermined calculation in accordance with a control signal from the microprogram memory section 29, stores the calculation result into the external RAM 33 via a selector 31 as may be necessary, and reads out the calculation result from the RAM 33 to perform further calculation thereon to provide complex signal processing. The ultimate output from the calculation section 33 is sent to the DAC 44. The microprogram memory section 29, into which microprograms are written by the CPU 50 via the interface 34, sequentially outputs the microprograms in response to the output value of the program counter 110, as shown in detail in FIG. 14. In this section 29, components denoted by reference characters 110 to 116 are the same in function as those in FIG. 10 and hence will not be described here to avoid unnecessary duplication. The output from an OR circuit 99 and clock $\phi 0$ are supplied to an OR circuit 108, and the resultant output from the OR circuit 108 is applied as a reset signal to a counter 107, so that reset at the counter 107 is reset at the outset of each channel to perform counting by use of clock $\phi 1$ and supplies its counted value to an adder 101.

Four program top address registers 103 to 106 are provided in corresponding relation to the channels. The CPU, via the interface 34, writes into the address registers 103 to 106 the respective start addresses of the programs stored in a microprogram memory 100 which are to be allocated to the individual channels, and the registers 103 to 106 output the thus-written addresses to a selector 102. Further with reference to FIG. 11, the start address of program 1 is written into the program top address register 103, the start address of program 4 into the address register 104, the start address of program 2 into the address register 105, and the start address of program 6 into the address register 106.

The counter 98 sequentially outputs "0", "1", "2" and "3" in correspondence to channel executing time slots, so that the selector 102 sequentially selects the start addresses of the programs allocated to the individual channels A, B, C and D to sequentially output the selected addresses to the adder 101. The adder 101 adds the selected start address to the output counted value of the counter 107 and supplies the result to the microprogram memory 100. In the microprogram memory 100, a microprogram is read out by using, as a read address, the output counted value of the counter 107. The read-out microprogram is supplied as a control signal to the calculation section 30, various components of the DSP 43, and the external RAM 33 to be used for signal processing therein.

Again, referring back to FIG. 10, the output from AND circuit 28 becomes a logical "0" when the microprogram memory section 29 is outputting a negative-logic write or read signal to the external RAM 33, so that the AND circuit 26 also outputs "0" to a selector 32. In turn, the selector 32 passes the output from the adder 117 to the external RAM 33 as an address. The output value "0" of the AND circuit 26 is also supplied to the selector 31, which thus selects the signal line of the calculation section 30. As a result, the calculation section 30 is connected with the data terminal of the external RAM 33.

The output from the AND circuit 26 is also supplied to a selector 27 as a select signal; and therefore, when the output from the AND circuit 26 is at "0", the selector 27 supplies a write-enable signal from the microprogram memory section 29 to the write-enable terminal of the external RAM 33. Consequently, when the microprogram is accessing the external RAM 33 for data read or write, the data terminal is connected to the calculation section 30 with the address terminal being connected to the address output corresponding to any of the programs allocated to the channels, normal data read/write is performed with respect to the external RAM 33. To the output-enable signal is applied an output-enable signal directly from the microprogram memory.

On the other hand, when the microprogram memory section 29 is not supplying a write or read signal to the external RAM 33, the AND circuit 28 outputs a logical "1" to the AND circuits 26 and 120. The AND circuit 120 is also supplied with $\phi 1$ so that while no access is made to the external RAM 33, the AND circuit 120 outputs clock pulses to cause a counter 119 to perform counting for each step. A reset signal to the counter 119 is provided from the CPU 50 via the interface 34.

The output counted value of the counter 119 is provided to an adder 21, where the counted value is added to a start address, supplied from a start address register 22, of a specific storage area of the RAM 33 to be erased. Thus, utilizing a period when the external RAM 33 is not in use, the adder 21 sequentially outputs addresses to be erased beginning with the start address of the specific storage area of the RAM 33. The output from the adder 21 is passed to the selector 32, where it is selected as an address to access the external RAM 33 when the output from the AND circuit 26 is at "1". The output from the AND circuit 26 is also supplied as a select signal to the selectors 27 and 32 in such a manner that each of the selectors 27 and 32 selects "0" when the output from the AND circuit 26 is at "1". Thus, such selection of "0" results in a write instruction to the external RAM 33, and data "0" is written into an address of the RAM 33 which corresponds to the output value of the adder 21.

The output value of the adder 21 is also applied to a comparator 23 for comparison with the output from an adder 36, so that once both the outputs coincide with each other, the comparator 23 outputs a reset signal to a flip-flop 25. The adder 36 adds "1" to an end address supplied from an end address register 24. A set signal is sent from the CPU 50 to the flip-flop 25 via the interface 34. The thus-set flip-flop 25 outputs "1" to the AND circuit 26, and it is reset by a coincidence signal output from the comparator 23. The thus-reset flip-flop 25 outputs a logical "0" to cause the AND circuit 26 to output "0", so that the selectors 27, 31 and 32 will select the write-enable signal from the microprogram memory section 29, output from the adder 117 and output signal from the calculation section 30, respectively.

The output from the adder 21 is sent via the interface 34 to the CPU 50 to indicate that the required clearing has been completed.

The CPU 50 writes, into the start address register 22, the start address of the specific storage area of the RAM 33 to be cleared, and also writes the end address of the specific storage area into the end address register 24. After that, by sending reset and set signals to the counter 119 and flip-flop 25, respectively, the CPU 50 keeps sequentially writing "0" into the start to end addresses during a period when the microprogram memory is not accessing the external RAM 33. Then, once the output from the adder 21 coincides with an address corresponding to the end address plus one, the clearing is terminated, and the termination is signalled via the interface 34 to the CPU 50 in the form of a clear termination flag. Upon reading the clear termination flag, the CPU 50 stores the specific storage area as a cleared storage area in preparation for allocation that will require the cleared storage area. If there is still any other storage area to be erased, the above-mentioned clearing operation will be repeated for that storage area.

With the arrangement described above, any storage area can be erased during a period when the external RAM 33 is not being used by a microprogram, and this allows required clearing to be performed even while the microprogram is executed, so that the microprogram processing will not be interrupted due to the clearing. Thus, the arrangement will be found to be particularly suitable for applications requiring dynamic allocation of a cleared storage area.

The following describes one application of the signal processor of the invention.

Figure 15:
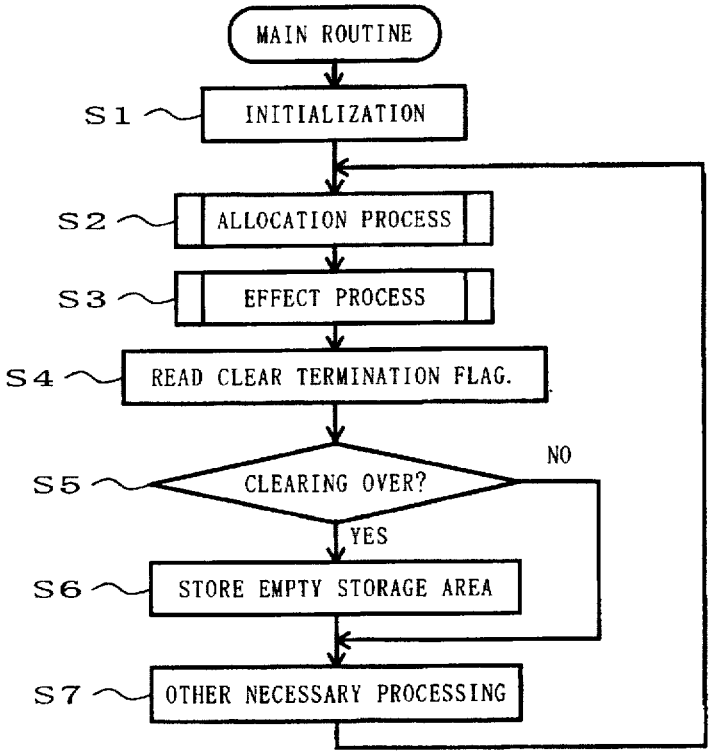
FIG. 15 is a flowchart illustrating a main routine performed in the electronic musical instrument of FIG. 12.

FIG. 15 is a main routine flowchart explanatory of the general operation of the electronic musical instrument shown in FIG. 12. Upon power-on, an initialization process is performed in step S1 to clear various registers, load initial values to various registers, etc. In particular, for the DSP 43, a default program and coefficient and address corresponding to the program are read out from the ROM 48 and transferred to the microprogram memory section 29 and coefficient and address registers of the calculation section 30, respectively.

Figure 16:
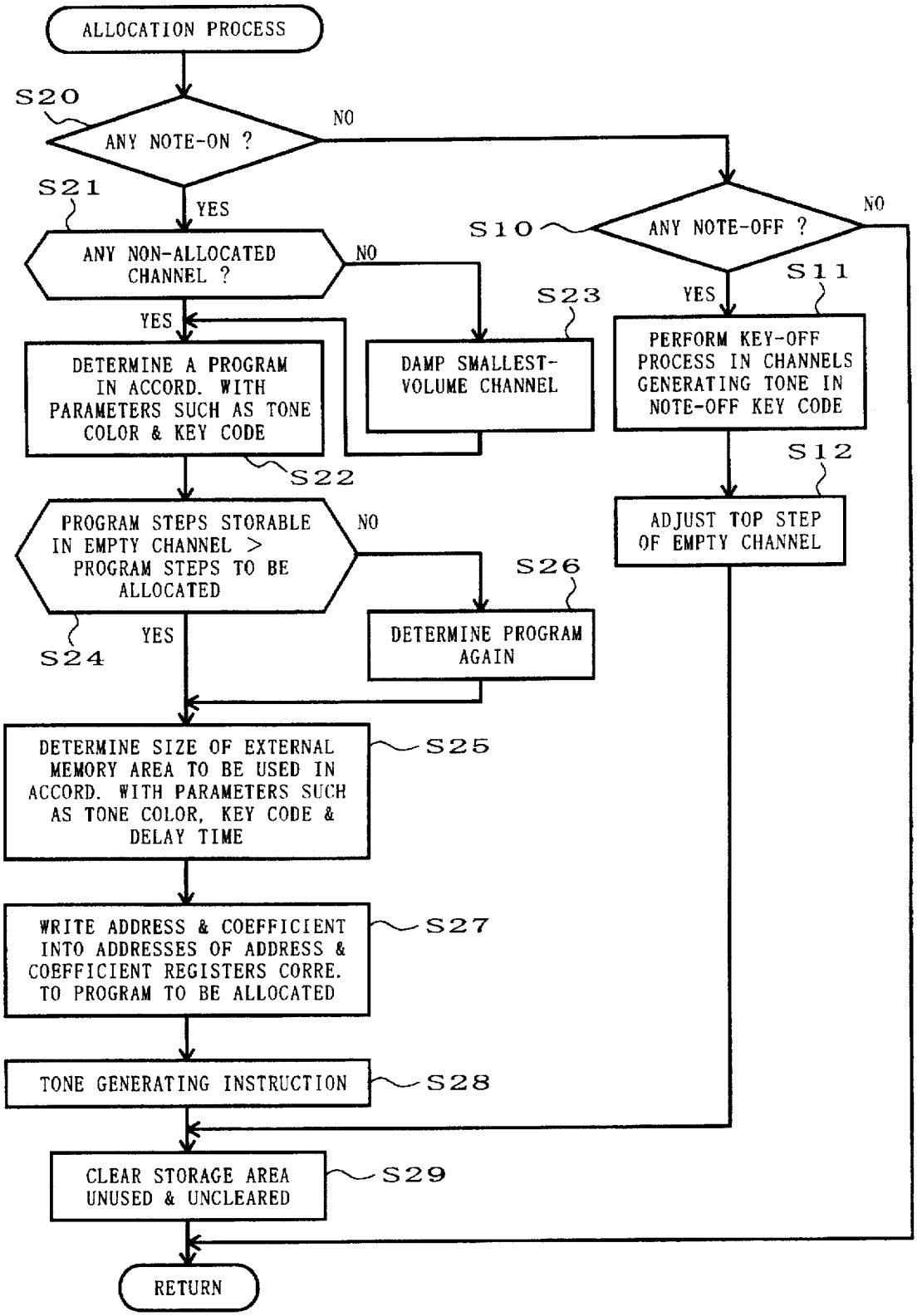
FIG. 16 is a flowchart illustrating an example of an allocation process shown in FIG. 15.

After the initialization, an allocation process subroutine is performed in step S2 to execute a program corresponding to a flowchart of FIG. 16. First, in step S20, a determination is made as to whether there has occurred any note-on event. The determination becomes affirmative (YES) when any of the keys is depressed or operated on the keyboard 37 or when a note-on event is received from an unillustrated external MIDI instrument, and then the flow proceeds to step S21.

In step S21, it is determined whether any of the four channels in the DSP 43 is an empty or non-allocated channel. Here, the term "non-allocated channel" is one where no tone is being currently generated or which is currently practically not involved in outputting a tone. The program allocated to the channel is then in operation, but its output amount is limited. An affirmative determination in step S21 signifies that there is a channel not in use (unused channel), and thus the flow proceeds to step S22, where a program to be allocated is determined in accordance with tonal parameters such as a tone color and key code and the start address of the program to be allocated is written into the program top address register corresponding to the empty channel.

With a negative (NO) determination in step S21, the flow branches to step S23, in which a damping process is performed for one of the channels where the volume of tone is the smallest to terminate generation of the tone. Thus, an empty channel is created compulsorily.

In step S24, a comparative determination is made as to whether the number of program steps capable of being stored in the empty channel is equal to or greater than the number of steps of the determined program to be allocated. If the determination in step S24 is in the affirmative, this means that the program allocation to the empty channel is possible, and hence the flow proceeds to step S25. If not, this means that the program allocation to the empty channel is impossible, and the flow branches to step S26 to determine another program whose size is small enough for the empty channel. Specifically, a program is determined whose program size is small enough for replacement.

In step S25, the size of the external memory area to be used is determined by parameters such as tone color, key coded and delay time and is allocated to a cleared storage area. This is done by writing the size and bottom address of the storage area into the area size and bottom address registers, respectively, of the address counter 91 corresponding to the empty channel. In next step S27, address and coefficient data for the allocated program are transferred and written into addresses in the address register 118 and coefficient register of the calculation section 30 corresponding to the program to be allocated.

Further, in step S28, a tone generating instruction is given to the corresponding channel of the tone source 42 to initiate tone generation. For simplicity of description, it is assumed here that the channels of the tone source 42 and DSP 43 correspond to each other. A tone generating instruction is also provided to the corresponding channel of the DSP 43. Specifically, this instruction is intended for causing coefficient interpolation and envelope generation to start, although not described in detail here because these are matters depending on program algorithms.

In next step S29, in order to clear any of the storage areas in the external RAM which is unused and yet uncleared, the start and end addresses of the storage area are written into the start and end address registers 22 and 24, respectively. After that, the flow returns to the main routine.

If, on the other hand, there has occurred no note-on event as determined in step S20, the flow branches to step S10, where a determination is made as to whether there has occurred any note-off event. With an affirmative determination, the flow goes to step S11 in order to perform a key-off process in the tone source and DSP channels generating a tone of the key code corresponding to the note-off event.

In next step S12, if the channel preceding the one emptied due to the key-off operation is in use and if the size of the program allocated to the preceding channel is smaller that the program formerly allocated thereto, this means that there are one or more program steps unused, and thus the top step register corresponding to the empty channel is rewritten in such a manner that no unused program step will occur. This is done for maximizing the capacity of the storage area corresponding to the empty channel, in preparation for future allocation to the storage area of a large-size program. Then, the flow goes to step S29. If it is determined in step S10 that no note-off event has occurred, the flow returns to the main routine.

Figure 17:
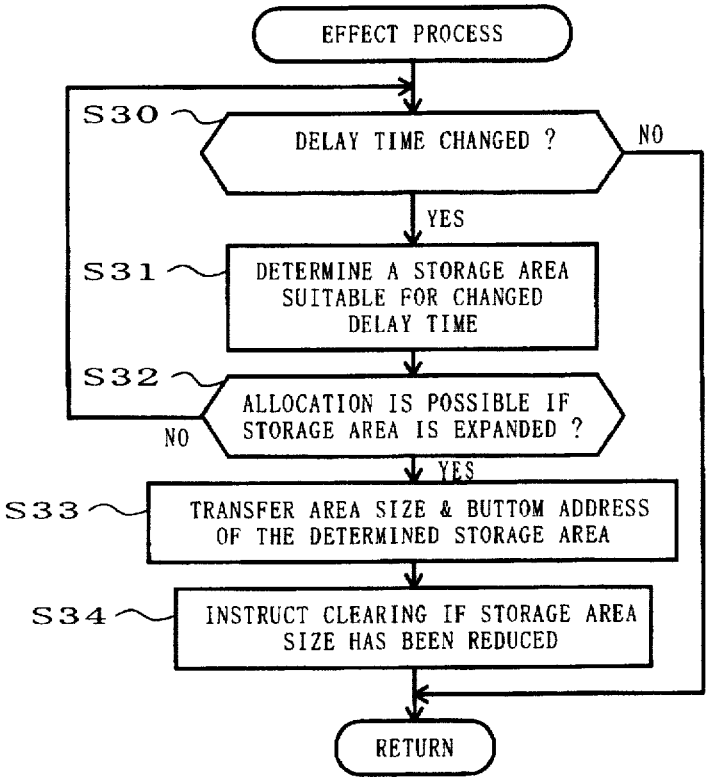
FIG. 17 is a flowchart illustrating an example of an effect process shown in FIG. 15.

Upon returning to the main routine, the flow is directed to step S3 to perform an effect process subroutine of FIG. 17. In step S30 of the effect process subroutine, it is determined whether delay time has been changed or not. If the delay time has been changed by a predetermined operating member 41 or in response to a parameter change message from the unillustrated external MIDI instrument, the flow proceeds to step S31 in order to determine one of the storage areas in the external RAM which is suitable for the changed delay time. Then, in step S32, it is checked whether the determined storage area can actually be used for allocation, because it is probable that no unused storage area is present in the external RAM if the area is increased in size or expanded, although allocation is possible if the storage area is reduced in size. If the allocation is impossible, the flow reverts to step S30 to wait for the delay time to be changed again. At this time, it is preferable that an error message be displayed on the LCD 40 to urge the user or player to change the delay time.

If the required allocation is possible as determined in step S32, the size and bottom address of the storage area determined in step S31 are transferred to the area size register 94 and bottom address register 95, respectively, corresponding to the channel to which the effect is allocated (step S33). In step S34, the start and end addresses of the storage area requiring clearing due to area size reduction are written into the start and end address registers 22 and 24, respectively. Then, the counter 119 is reset and the flip-flop 25 is set so as to initiate the clearing. After that, the flow returns to the main routine. Where the delay time has not been changed, as determined in step S30 as well, the flow returns to the main routine.

Referring again to the main routine, the interface 34 is accessed in step S4 to read the clear termination flag, and then it is determined in step S5 whether the clearing has been terminated. With an affirmative determination in step S5, the empty storage area is stored in preparation for next allocation. Where there is still storage area requiring clearing, another clearing instruction is issued. After that, the flow reverts to step S2 after other necessary processing is performed in step S7. If step S5 determines that the clearing has not been terminated yet, the flow jumps to step S7 for the other necessary processing. By repeating the operations of steps S2 to S7 in the above-mentioned manner, the clear termination flag is read periodically so that it is always possible to recognize the time when the clearing is terminated.

With the signal processor arranged in the above-described manner, the memory storage area to be used by a program can be changed, and hence the memory can be used with utmost efficiency. Further, because a program for generating or processing tone can be selected to perform actual generation and processing of tone in accordance with the selected program, tone processing suitable for time-varying performance information can be achieved. Furthermore, because any of the memory storage areas requiring clearing is actually cleared at timing when the memory is not being used by a program, the clearing can be performed independently of the program execution.

What is claimed is:

1. An effect imparting apparatus comprising:

effect impartment means including storage means having at least two storage areas for a single channel to be used for delaying tone sample data, said effect impartment means performing a delaying process to sequentially delay plural sample data of a tone by use of one of said at least two storage areas, to impart a predetermined effect to the tone in the single channel on the basis of said delaying process;

input means for inputting into said effect impartment means tone sample data to which an effect is to be imparted;

supply means for supplying control information indicating that tone generation for first tone sample data previously inputted to said effect impartment means via said input means should be damped in the single channel to allow second tone sample data to be next inputted to said effect impartment means in place of said first tone sample data; and control means responsive to said control information for inhibiting use of the one of said at least two storage areas which has been used for the delaying process of said first tone sample data in the single channel, to allow another of said at least two storage areas to be used for the delaying process of said second tone sample data in the single channel.

2. An effect imparting apparatus as defined in claim 1, further including plural channels that include the single channel, wherein said input means inputs into said effect impartment means the tone sample data individually for the plural channels, and said effect impartment means imparts individual effects to said tone sample data input for the plural channels, and wherein said control information is supplied by said supply means in a case where said first tone sample data is first input for a specific one of the plural channels and then said second sample data is input for said specific one of the plural channels.

3. An effect imparting apparatus comprising:

effect impartment means for imparting tonal effects individually for plural channels, said effect impartment means including storage areas to be used for delaying tone sample data of each of said plural channels separately from other of said plural channels, the number of said storage areas being greater than the number of said plural channels by at least one, said effect impartment means performing a delaying process to sequentially delay plural sample data of a tone for any one of the plural channels by use of one of said storage areas, to impart a predetermined tonal effect to the tone on the basis of said delaying process to the any one of the plural channels;

input means for inputting tone sample data into said effect impartment means individually for the plural channels; and control means for, when new tone sample data is inputted for a specific one of the plural channels via said input means, allocating an unused one of said storage areas for said specific channel of the plural channels so that said unused storage area is newly used for the delaying process of the new tone sample data in the specific one of the plural channels.

4. An effector as defined in claim 3, wherein each of said storage areas has a size that is optionally varied in size rather than being fixed in size.

5. An effect imparting apparatus comprising:

an effect impartment circuit that includes a storage device having at least two storage areas for a single channel to be used for delaying tone sample data, the effect impartment circuit performing a delay process to sequentially delay plural sample data of a tone by use of one of the at least two storage areas, to impart a predetermined effect to the tone in the single channel on the basis of the delay process;

an input circuit that inputs tone sample data, to which an effect is to be imparted, into the effect impartment circuit;

a supply circuit that supplies control information indicating that tone generation for first tone sample data previously inputted to the effect impartment circuit via the input circuit should be damped in the single channel to allow second tone sample data to be next inputted into the effect impartment circuit in place of the first tone sample data; and a control circuit responsive to said control information for inhibiting use of the one of the at least two storage areas which has been used for the delay process of the first tone sample data in the single channel, to allow another of the at least two storage areas to be used for the delay process of the second tone sample data in the single channel.

6. An effect imparting apparatus as defined in claim 5, further including a plurality of channels that include the single channel, wherein the input circuit inputs the tone sample data individually for the plurality of channels into the effect impartment circuit, and the effect impartment circuit imparts individual effects to the tone sample data input into the plurality of channels, and wherein the control information is supplied by the supply circuit in a case where the first tone sample data is first input for a specific one of the plurality of channels and then the second tone sample data is input for another specific one of the plurality of channels.

7. An effect imparting apparatus comprising:

an effect impartment circuit that imparts tonal effects individually for each of a plurality of channels, the effect impartment includes storage areas used to delay tone sample data of each of the plurality of channels separately from other of the plurality of channels, the number of the storage areas being greater than the number of the plurality of channels by at least one, the effect impartment circuit performs a delay process to sequentially delay plural sample data of a tone for any one of the plurality of channels by use of one of the storage areas, to impart a predetermined tonal effect to the tone on the basis of the delay process to the any one of the plurality of channels;

an input circuit that inputs tone sample data into the effect impartment means individually for each of the plurality of channels; and a control circuit that, when new tone sample data is inputted for a specific one of the plurality of channels via the input circuit, allocates an unused one of the storage areas for the specific channel of the plurality of channels so that the unused storage area is newly used for the delay process of the new tone sample data in the specific one of the plurality of channels.

8. An effector as defined in claim 7, wherein each of the storage areas has a size that is optionally varied in size rather than being fixed in size.

* * * * *